United States Patent [19]

DiCarlo

[11] Patent Number: 4,530,154

[45] Date of Patent: Jul. 23, 1985

[54] SLITTER ASSEMBLY

[75] Inventor: Carlton DiCarlo, Paramus, N.J.

[73] Assignee: DiCarlo Pen Company, Paramus, N.J.

[21] Appl. No.: 583,885

[22] Filed: Feb. 27, 1984

Related U.S. Application Data

[63] Continuation of Ser. No. 291,384, Aug. 10, 1981, abandoned, and a continuation-in-part of Ser. No. 47,741, Jun. 12, 1979, abandoned, and Ser. No. 239,459, Mar. 2, 1981, abandoned.

[51] Int. Cl.[3] ..... B26B 29/00

[52] U.S. Cl. ..... 30/294; 30/DIG. 3

[58] Field of Search ..... 30/294, 289, DIG. 3

[56] References Cited

U.S. PATENT DOCUMENTS

| | | | |
|---|---|---|---|
| 2,233,497 | 3/1941 | Teigen | 30/DIG. 3 |
| 2,255,196 | 9/1941 | Taylor | 30/289 |
| 2,291,294 | 7/1942 | Holste | 30/294 |
| 2,298,024 | 10/1942 | Vallarelli | 30/294 |
| 2,456,436 | 12/1948 | Metzger | 30/294 |
| 2,688,187 | 9/1954 | Pauli | 30/294 |
| 3,153,853 | 10/1964 | Lipton | 30/DIG. 3 |
| 3,430,339 | 3/1969 | Hobson | 30/151 |
| 3,824,688 | 7/1974 | Goffe | 30/294 |
| 3,835,536 | 9/1974 | Marcoux | 30/294 |
| 3,898,735 | 8/1975 | Himeno | 30/DIG. 3 |

FOREIGN PATENT DOCUMENTS

| | | | |
|---|---|---|---|
| 560115 | 3/1975 | Switzerland | 30/DIG. 3 |

*Primary Examiner*—Frederick R. Schmidt
*Assistant Examiner*—J. T. Zatarga
*Attorney, Agent, or Firm*—Louis E. Marn

[57] ABSTRACT

There is disclosed a slitter assembly comprised of a body member formed with a slot and having a cutter assembly including a cutting blade mounted in the body member whereby the cutting blade protrudes a predetermined distance into the slot whereby insertion of an edge portion of an envelope into the slot with subsequent movement of the slitter assembly along such edge portion of the envelope effects the cutting of one element of an edge thereof.

2 Claims, 9 Drawing Figures

10
14
30
24
10
3
16
12
14
28
A
26

3
16
12
22
20
44
42
40
38
32
36

β
8
46
48
α

16
12
18
20
22

112
116
118
120
122

8
110
114
152
144
146
140
145
136
138
132
134
126
8

152
147
143
149
112
116
136
146
134

SLITTER ASSEMBLY

This is a continuation of application Ser. No. 291,384, filed Aug. 10, 1981, now abandoned. This application is a continuation-in-part of U.S. application Ser. No. 047,741 filed June 12, 1979 (now abandoned), and of U.S. application Ser. No. 239,459 filed Mar. 2, 1981 (now abandoned).

FIELD OF THE INVENTION

This invention relates to a slitter assembly, and more particularly to an envelope slitter assembly for slitting one sheet element of an envelope.

BACKGROUND OF THE INVENTION

In the process of opening envelopes, many forms of devices, such as knife, saber or epee-like assemblies, have been employed to slit the flap edge of an envelope to permit access to the contents thereof. The use of such devices are inherently dangerous leading to cut and puncture type wounds through careless usage. In copending application, Ser. No. 239,459, there is disclosed a hand-held sheet material cutter comprised of a blade permanently secured in a solid holder and having a cutting edge thereof protruding a predetermined distance greater than the thickness of a sheet of material, such as paper to be cut but of a distance insufficient to effect cutting of a subadjacent sheet thereto.

OBJECTS OF THE INVENTION

It is an object of the present invention to provide a novel envelope slitter assembly.

Another object of the present invention is to provide a novel envelope slitter assembly for readily slitting an element of an edge of an envelope.

Still another object of the present invention is to provide a novel envelope slitter assembly for readily slitting one side of a closed envelope.

A further object of the present invention is to provide a novel envelope slitter assembly for readily slitting an extreme edge of an envelope.

Yet another object of the present invention is to provide a novel envelope slitter assembly for slitting an element of an edge of an envelope obviating problems associated with knife-like envelope opening devices.

A still further object of the present invention is to provide a novel envelope slitter assembly substantially eliminating the inadvertent damaging to the contents thereof.

Still another object of the present invention is to provide a novel envelope slitter assembly which may be readily handled and conveniently carried without the concomitant inherent problems associated with knife-life envelope opening devices.

SUMMARY OF THE INVENTION

These and other objects of the present invention are achieved by a slitter assembly comprised of a body member formed with a slot and having a cutting blade assembly including a cutting blade mounted in the body member such that a cutting edge of the cutting blade protrudes a predetermined distance into the slot whereby insertion of an edge portion of an envelope into the slot with subsequent relative movement of the slitter assembly to such edge portion of the envelope effects the cutting of such edge portion of the envelope.

BRIEF DESCRIPTION OF THE DRAWINGS

A better understanding of the present invention as well as other objects and advantages thereof will become apparent upon consideration of the detailed disclosure thereof, especially when taken with the accompanying drawings wherein like numerals designate like parts throughout, and wherein.

DETAILED DESCRIPTION OF THE DRAWINGS

Figures 1, 2, 3, 4, 5, 6, 7, 8, 9:
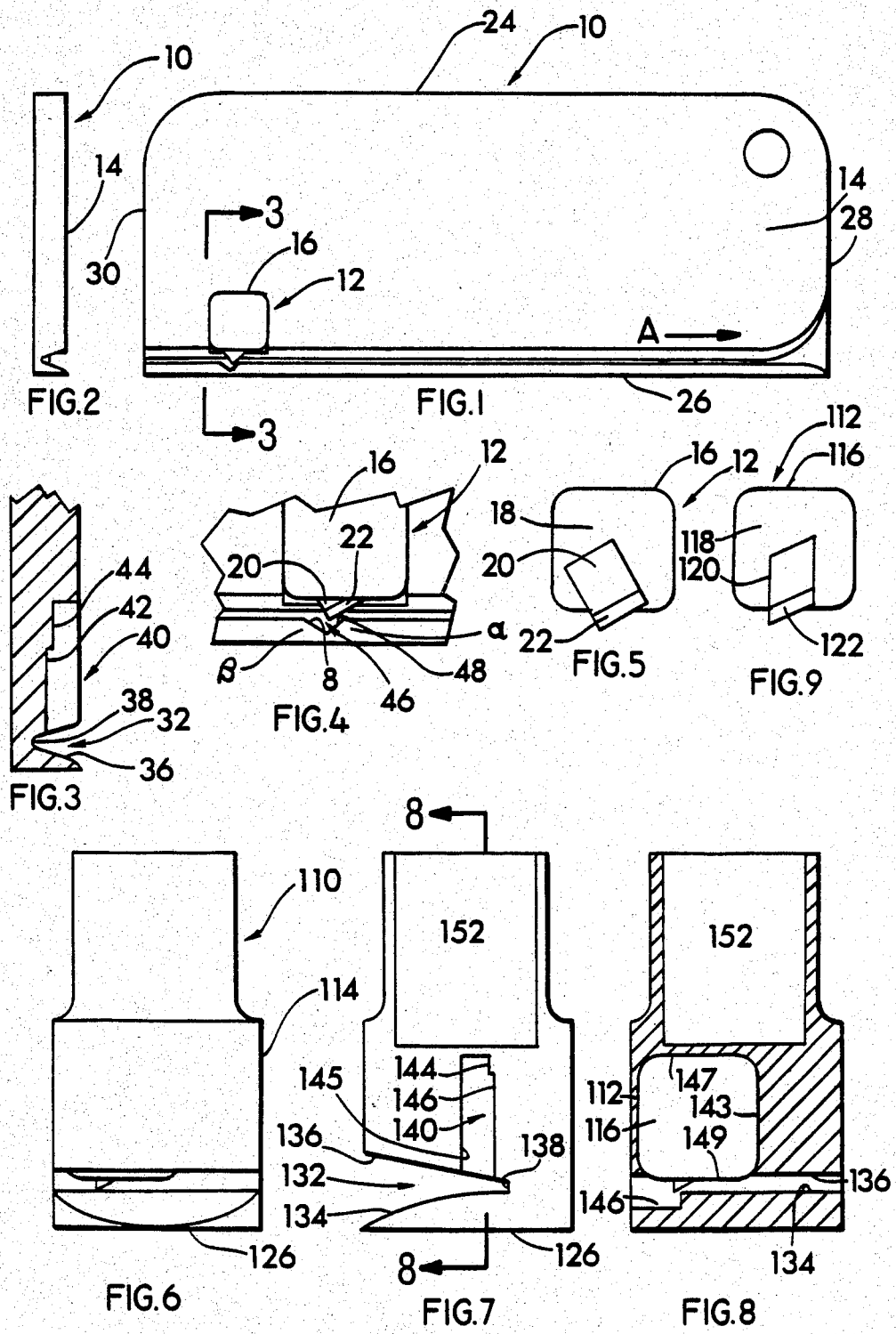
FIG. 1 is an elevational view of one embodiment of the present invention.
FIG. 2 is a side view thereof.
FIG. 3 is an enlarged cross-sectional view, with the cutting blade assembly omitted, taken along the lines 3—3 of FIG. 1.
FIG. 4 is an enlarged partial elevational view illustrating the mounted cutting blade assembly.
FIG. 5 is a rear elevational view of the cutting blade assembly.
FIG. 6 is a side elevational view of another embodiment of the present invention.
FIG. 7 is a cross-sectional view, with the cutting blade assembly omitted, taken along the lines 7—7 of FIG. 6.
FIG. 8 is a cross-sectional view taken along the lines 8—8 of FIG. 7.
FIG. 9 is a rear elevational view of the cutting blade assembly for the embodiment of FIGS. 6 to 8.

Referring now to FIGS. 1 to 5, and particularly to FIG. 1, there is illustrated a slitter assembly, generally indicated as 10, comprised of cutting blade assembly, generally indicated as 12, mounted to a body member 14.

The cutting blade assembly 12, is comprised of a square-shaped base member 16 including a mounting surface 18 and a cutting blade 20 including a cutting edge 22 diagonally-mounted on the mounting surface 18 of the base member 16, such as by welding or glueing, in a position whereby the cutting edge 22 extends a distance of about 0.040 inches from the base member 16. The base member 16 is generally formed of any non-deformable material, such as steel, zinc, plastic or the like, whereas the cutting blade 20 is preferably formed of carbon steel or the like.

The body member 14 is generally rectangularly-shaped and is defined by a top edge 24, a bottom edge 26, a leading side edge 28 and a trailing side edge 30, referring particularly to FIG. 1. Proximate to the bottom edge 26 and parallelly-disposed thereto, there is formed an elongated slot, generally indicated as 32, formed by an inwardly and downwardly extending intermediate top wall 34 and inwardly and upwardly extending intermediate bottom wall 36 terminating by a U-shaped channel portion 38, referring particularly to FIG. 3.

In the body member 14, proximate the trailing side edge 30 and above the slot 32, there is formed a generally square-shaped chamber, generally indicated as 40, defined by an inner wall portion 42 and an intermediate stepped wall portion 44, referring now to FIG. 3, for mounting the cutting blade assembly 12 essentially perpendicular to the axis of the slot 32. A small V-shaped notch, generally indicated as 46, is formed in the body member 14 below the slot 32 proximate the bottom edge 18 corresponding generally to the outwardly extending portion of the cutting edge 22 of the cutting blade 20.

The V-shaped notch 46 is formed by a wall segment 48 extending downwardly from the intermediate bottom wall 36 towards the bottom edge 26 of the trailing side edge 30 of the body member 14 and by a wall segment 50 extending upwardly from a lower portion of the wall segment 48 to the intermediate bottom wall 36. The wall segments 48 and 50 defining angles $\alpha$ and $\beta$ with the axis of the slot 32, with the angle $\alpha$ being greater than the angle $\beta$, e.g. 45° and 30°, respectively. The notch 46 is necessary to permit the envelope (not shown) or the like to slide and dip slightly during relative movement, as more fully hereinafter discussed. The body member 12 is provided with an orifice or hole 52 to permit attachment of the slitter assembly 10 to a chain or like device (not shown), or on a hook (not shown).

In operation, an edge of an envelope or like assemblage (not shown) proximate a corner thereof is placed in the slot 32 of the slitting assembly 10 with the slitting assembly 10 being preferably vertically-positioned with the bottom edge 26 disposed on a support base (not shown). As the envelope to be slit is inserted into the slot 32, the upper or top element of the envelope is caused to be raised into contact with the cutting edge 22 of the cutting blade 20 by upward movement thereof resulting from inserting contact with the inwardly and upwardly extending intermediate bottom wall 36 forming the slot 32 together with the intermediate top wall 34. The slitting assembly 10 is thereupon caused to be moved relative to the edge of the envelope in the direction of arrow A, referring to FIG. 1, whereby the upper sheet of the envelope assemblage is cut or severed by the cutting edge 22 of the cutting element 20.

As hereinabove mentioned, the notch 46 permits the envelope to slide and dip slightly thereby to cause a slight bulge permitting free slitting the top element of the envelope in contact with the cutting edge 22 of the cutting blade 20 while minimizing jamming of the envelope being passed through the slitter assembly 10. The process may be repeated for the other edges of the envelope.

FIGS. 6 to 9 illustrates another embodiment of the present invention wherein a slitting assembly, generally indicated as 110, is comprised of a cutting blade assembly 112 mounted in a cylindrically-shaped body 114 formed at one end with a cylindrically-shaped chamber 152 coaxial with the slitting assembly 110 for positioning the slitting assembly 110 on an end of a pencil, pen or like instrument.

The slitting assembly 110 is formed with a flat bottom stabilizing wall 126 and a generally V-shaped slot, generally indicated as 132, referring particularly to FIG. 7, proximate the bottom wall 126 and having an axis in a plane generally perpendicular to the axis of the slitting assembly 110. The slot 132 is formed by an inwardly and downwardly extending intermediate top wall 134 and an inwardly and upwardly extending intermediate bottom wall 136 terminating by a U-shaped channel portion 138.

The slitting assembly 110 is formed with a rectangularly-shaped slot 140, disposed in a plane generally parallel to the plane of the axis of the slitting assembly 10 and in a plane generally perpendicular to the axis of the slot 132. The rectangularly-shaped chamber 140 is defined by an end wall portion 143, an inner wall portion 142 including an intermediate stepped wall portion 144, an opposed inner wall portion 145 and top and bottom wall portions 147 and 149, respectively, referring to FIG. 7, for mounting the cutting blade assembly 112 therein. A portion of bottom wall 136 of the slitting assembly 110 beneath the slot 132 is formed with a channel 146 corresponding generally to the outwardly extending portion of the cutting edge 122 of the cutting blade 120.

The cutting blade assembly 112, referring particularly to FIG. 9, is comprised of a square-shaped base member 116 including a mounting surface 118 and a parallellogramatically-shaped cutting blade 120 including a cutting edge 122 parallelly-mounted on the mounting surface 118 of the base member 116 in a position whereby the cutting edge 122 extends a distance of about 0.040 inches from the base member 116. The configuration of the cutting blade 120 to the base member 116 permits of more positive slitting action due to the shorter length of the slot 132 compared with the slot 32 of the slitting assembly 10 of the embodiment of FIGS. 1 to 5.

Operation of the slitting assembly 110 is similar to that of the slitting assembly 10 with the assembly 110 being firmly positioned on a support surface (not shown) with the bottom wall 126 in contact therewith. It will be understood that the slitting assemblies of the present invention may be used in a manner other than as described.

The present invention is effective in slitting an element of an envelope assembly whether of thin papers or of thick manila construction. Obviously, to ensure non-slitting of the contents, the envelope is caused to be tapped edgewise to move the contents towards the tapped edge prior to slitting of the edge opposite the tapped edge.

Numerous modifications and variations of the invention are possible in light of the above teachings and therefore the invention may be practiced otherwise than as particularly described.

I claim:

1. A slitting assembly for an envelope type assemblage, which comprises:

a body member having a bottom wall and an exterior side wall, said body member including an elongated slot extending inwardly from said exterior side wall, said elongated slot being formed of an elongated intermediate top wall and an elongated upwardly extending intermediate bottom wall that terminate in an elongated channel portion within said body member, said body member further including a notched portion positioned along said elongated slot and extending downwardly into said elongated upwardly extending intermediate bottom wall, said notched portion being comprised of a first wall segment and a second wall segment within said elongated upwardly extending intermediate bottom wall, said second wall segment being positioned after said cutting edge and intersecting said first wall segment, said first wall segment forming an angle $\alpha$ with a longitudinal axis of said elongated slot, and said second wall segment forming an angle $\beta$ with said longitudinal axis, said angle $\alpha$ being greater than $\beta$ to permit said edge portion of said envelope type assemblage to slide and dip during relative movement through said elongated slot;

a mounting member attached to said body member above said elongated slot; and a cutting element including a cutting edge, said cutting element being affixed to said mounting member, said cutting edge extending at least partially across said elongated slot toward said notched portion, whereby upon longitudinal movement of an edge portion of said envelope type assemblage against said channel portion and through said elongated slot toward and into engagement with said cutting edge, said edge portion slides and dips into a separation between said cutting edge and said notched portion to effect slitting of only an upper sheet of said envelope type assemblage.

2. A slitting assembly in accordance with claim 1 wherein said exterior side wall is positioned perpendicular to said bottom wall, said bottom wall having a flat surface for placement thereof on a support surface, and said elongated slot is formed proximate to said bottom wall and is disposed parallel thereto.

* * * * *